US008408004B2

(12) United States Patent
Davis, Jr. et al.

(10) Patent No.: US 8,408,004 B2
(45) Date of Patent: Apr. 2, 2013

(54) RESONATOR ASSEMBLY FOR MITIGATING DYNAMICS IN GAS TURBINES

(75) Inventors: Lewis Berkley Davis, Jr., Niskayuna, NY (US); Fei Han, Clifton Park, NY (US); Shiva Srinivasan, Greer, SC (US); Kapil Kumar Singh, Rexford, NY (US); Kwanwoo Kim, Greer, SC (US); Venkateswarlu Narra, Greenville, SC (US)

(73) Assignee: General Electric Company, Schenectady, NY (US)

( * ) Notice: Subject to any disclaimer, the term of this patent is extended or adjusted under 35 U.S.C. 154(b) by 734 days.

(21) Appl. No.: 12/485,505

(22) Filed: Jun. 16, 2009

(65) Prior Publication Data

US 2010/0313568 A1 Dec. 16, 2010

(51) Int. Cl.
*F02C 3/00* (2006.01)
*F23R 3/46* (2006.01)

(52) U.S. Cl. ..... 60/772; 60/725

(58) Field of Classification Search ..... 60/772, 60/725, 39.37; 431/114
See application file for complete search history.

(56) References Cited

U.S. PATENT DOCUMENTS

| | | | | |
|---|---|---|---|---|
| 2,582,809 | A * | 1/1952 | Weir | 60/39.37 |
| 5,644,918 | A * | 7/1997 | Gulati et al. | 60/725 |
| 5,685,157 | A | 11/1997 | Pandalai et al. | |
| 5,857,319 | A * | 1/1999 | Sattelmayer | 60/39.37 |
| 6,205,765 | B1 | 3/2001 | Iasillo et al. | |
| 6,530,221 | B1 | 3/2003 | Sattinger et al. | |
| 6,840,048 | B2 * | 1/2005 | Han et al. | 60/725 |
| 6,962,043 | B2 | 11/2005 | Venkateswaran et al. | |
| 7,080,514 | B2 | 7/2006 | Bland et al. | |
| 7,140,186 | B2 | 11/2006 | Venkateswaran et al. | |
| 7,278,266 | B2 | 10/2007 | Taware et al. | |
| 7,337,057 | B2 | 2/2008 | Norman et al. | |
| 7,441,411 | B2 | 10/2008 | Gleeson et al. | |
| 2004/0025512 | A1 | 2/2004 | Davis, Jr. et al. | |
| 2007/0214796 | A1 * | 9/2007 | Bland et al. | 60/772 |
| 2009/0005952 | A1 | 1/2009 | Tonno et al. | |

* cited by examiner

*Primary Examiner* — Ted Kim
(74) *Attorney, Agent, or Firm* — Dority & Manning, P.A.

(57) ABSTRACT

A combustor for a gas turbine engine and related method is provided in which a plurality of combustor cans are selectively adapted with corresponding resonators. The resonators may, for example, be attached to every can in the consecutive arrangement of combustor cans, every other can, every third can or the like, and may be tuned to the same or first, second, third, etc. frequencies of operation. Such selective tuning is configured to suppress one or more of out-of-phase and in-phase dynamic interaction of streams discharged from adjacent combustor cans by changing the frequencies of pressure oscillation instabilities across the arrangement of consecutive cans.

5 Claims, 13 Drawing Sheets

RESONATOR ASSEMBLY FOR MITIGATING DYNAMICS IN GAS TURBINES

FIELD OF THE INVENTION

The subject matter disclosed herein relates to combustion dynamics control, and more particularly, to systems and methods for using resonators to reduce dynamics within a multi-can combustor.

BACKGROUND

In a gas turbine engine, air is pressurized in a compressor and mixed with fuel in a combustor for generating hot combustion gases that flow downstream through turbine stages where energy is extracted. Large industrial power generation gas turbine engines typically include a can combustor having a row of individual combustor cans in which combustion gases are separately generated and collectively discharged. Since the can combustors are independent and discrete components, each generating its respective combustion heat stream, the static and dynamic operation of the cans are inter-related.

Of particular concern to effective operation of can combustor engines is combustion dynamics, i.e., dynamic instabilities in operation. High dynamics are often caused by fluctuations in such conditions as the temperature of the exhaust gases (i.e., heat release) and oscillating pressure levels within a combustor can. Such high dynamics can limit hardware life and/or system operability of an engine, causing such problems as mechanical and thermal fatigue. Combustor hardware damage can come about in the form of mechanical problems relating to fuel nozzles, liners, transient pieces, transient piece sides, radial seals, impingement sleeves, and others. These problems can lead to damage, inefficiencies, or blow outs due to combustion hardware damage.

Thus, there have been various attempts to control combustion dynamics, thus preventing degradation of system performance. There are two basic methods for controlling combustion dynamics in an industrial gas turbine combustion system: passive control and active control. As the name suggests, passive control refers to a system that incorporates certain design features and characteristics to reduce dynamic pressure oscillations or heat release levels. Active control, on the other hand, incorporates a sensor to detect, e.g., pressure or temperature fluctuations and to provide a feedback signal which, when suitably processed by a controller, provides an input signal to a control device. The control device in turn operates to reduce dynamic pressure oscillations or excess heat release levels.

In considering the dynamic effects of both pressure fluctuations and heat release, it has been recognized in accordance with aspects of the present subject matter that there is a constructive coupling between the pressure oscillations and the heat release oscillations. In particular, combustion dynamics are increased when the heat release and pressure fluctuations are in phase with one another. Known solutions for mitigating passive dynamics have thus sought to reduce dynamics by one or more techniques, such as decoupling the pressure and heat release oscillations (e.g., by changing the flame shape, location, etc. to control heat release within a combustion engine) or dephasing the pressure and heat release.

One known apparatus used to address some dynamics concerns in various applications is a resonator. Although resonator assemblies have been used, their application has apparently been limited to the attenuation of high frequency instabilities by pure absorption of acoustic energy. For example, quarter wave resonators have been used to suppress acoustic energy in a combustion turbine power plant or to change the acoustic nature of a combustor in aviation applications.

The art is continuously seeking improved systems and methods for reducing high combustion dynamics, to improve system efficiency and extend the useful life of gas turbine engine components.

BRIEF DESCRIPTION OF THE INVENTION

In general, exemplary embodiments of the present invention provide a plurality of resonators selectively coupled to combustor cans within the combustion section of a gas turbine engine. Selective arrangement and tuning of the disclosed resonator assemblies is configured to reduce relatively high combustion dynamics by both absorbing acoustic energy and by changing the frequency levels among adjacent cans.

One exemplary embodiment of the present invention concerns a combustor for a gas turbine engine. The combustor comprises a plurality of consecutively arranged combustor cans for generating respective streams of combustion gases therein and collectively discharging the streams of combustion gases. The combustor further comprises a plurality of resonators coupled to selected ones of the combustor cans. A resonator may, for example, be attached to every can in the consecutive arrangement of combustor cans, every other can, every third can or the like. In addition, the resonators may be selectively configured to suppress pressure oscillations occurring at one or more given frequencies of operation.

Another exemplary embodiment of the present invention concerns a method for suppressing the dynamic interaction of cans among combustor cans in a gas turbine combustion engine. Such method comprises a step of providing a plurality of consecutively arranged combustor cans for generating respective streams of combustion gases therein and collectively discharging the streams of combustion gases. A plurality of resonators is also provided for being operatively coupled to selected ones of the combustor cans. The plurality of resonators are then selectively tuned to suppress one or more of out-of-phase and in-phase dynamic interaction of the streams discharged from adjacent cans in the plurality of consecutively arranged combustor cans.

BRIEF DESCRIPTION OF THE DRAWINGS

The invention, in accordance with preferred and exemplary embodiments, together with further advantages thereof, is more particularly described in the following detailed description taken in conjunction with the accompanying drawings in which.

DETAILED DESCRIPTION

Figure 1:
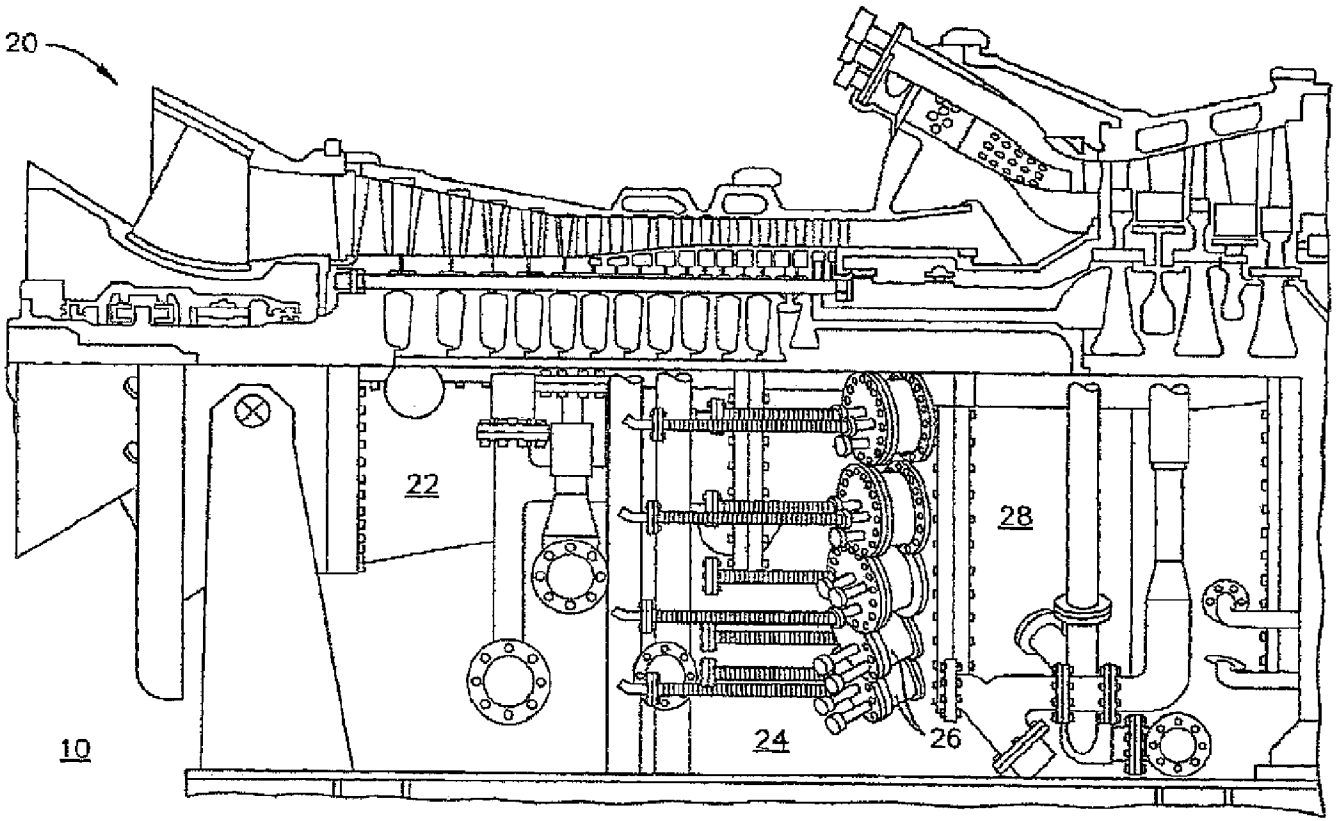
FIG. 1 is a side cutaway view of a gas turbine system that includes a gas turbine.

Reference is now made to particular embodiments of the invention, one or more examples of which are illustrated in the drawings. Each embodiment is presented by way of explanation of aspects of the invention, and should not be taken as a limitation of the invention. For example, features illustrated or described with respect to one embodiment may be used with another embodiment to yield a still further embodiment. It is intended that the present invention include these and other modifications or variations made to the embodiments described herein.

FIG. 1 is a side cutaway view of a gas turbine engine system 10 that includes a gas turbine engine 20. Gas turbine engine 20 includes a compressor section 22, a combustor section 24 including a plurality of combustor cans 26, and a turbine section 28 coupled to compressor section 22 using a shaft (not shown).

In operation, ambient air is channeled into compressor section 22 wherein the ambient air is compressed to a pressure greater than the ambient pressure. The compressed air is then channeled into combustor section 24 wherein the compressed air and a fuel are combined to produce a relatively high-pressure, high-velocity gas. Turbine section 28 extracts energy from the high-pressure, high-velocity gas discharged from combustor section 24, and the combusted fuel mixture is used to produce energy, such as, for example, electrical, heat, and/or mechanical energy. In one embodiment, the combusted fuel mixture produces electrical energy measured in kilowatt-hours (kWh). However, the present invention is not limited to the production of electrical energy and encompasses other forms of energy, such as, mechanical work and heat. Gas turbine engine system 10 is typically controlled, via various control parameters, from an automated and/or electronic control system (not shown) that is attached to gas turbine engine system 10.

Figure 2:
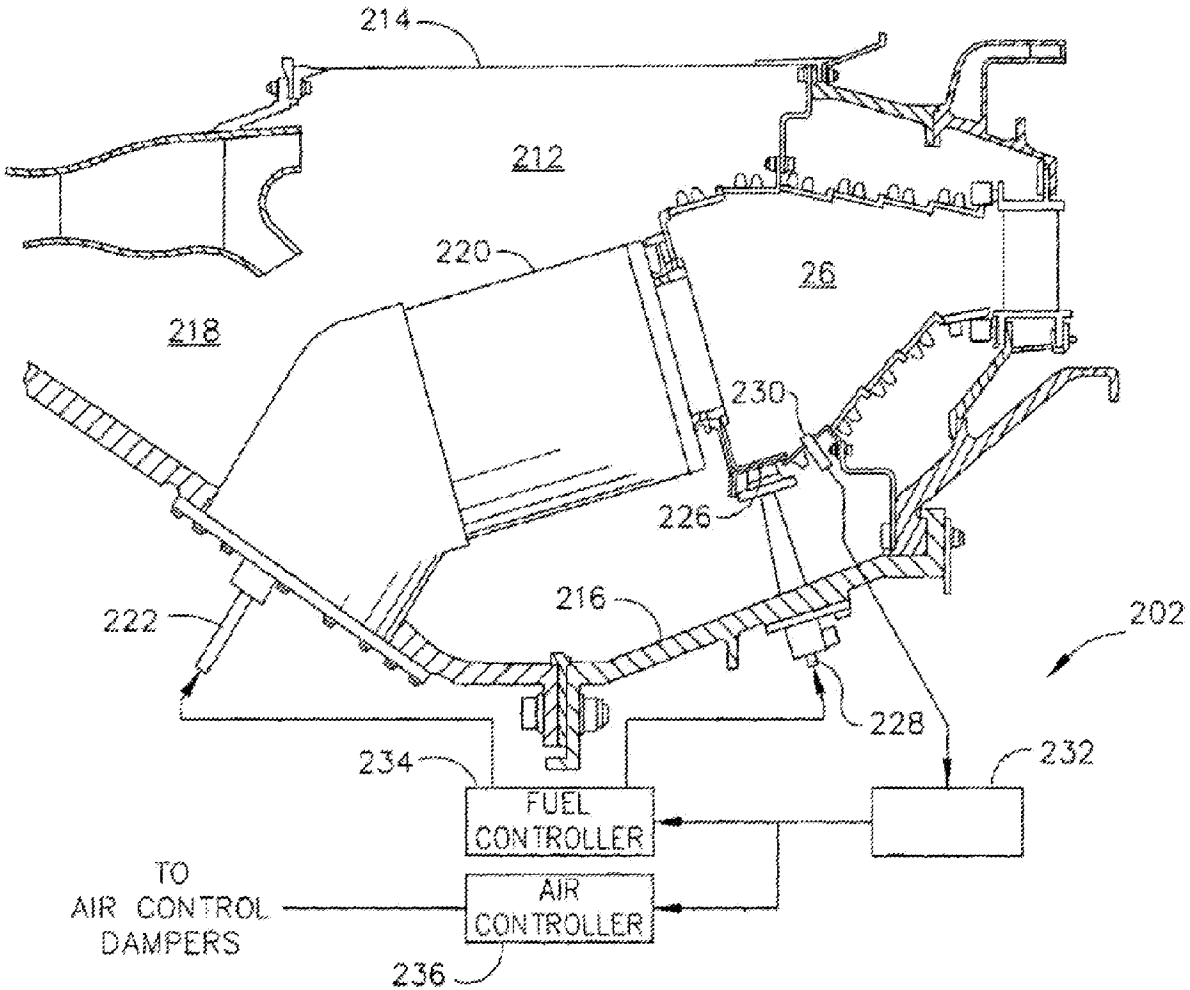
FIG. 2 is a schematic representation of a cross section of an exemplary gas turbine engine combustor can that may be used with the gas turbine engine shown in FIG. 1.

FIG. 2 is a schematic representation of a cross section of an exemplary gas turbine engine combustor can 26 and includes a schematic diagram of a portion of a gas turbine engine control system 202. An annular combustor 26 may be positioned within an annulus 212 between an inner engine casing 214 and an outer engine case 216. A diffuser 218 leads axially into annulus 212 from a compressor section 22 (shown in FIG. 1). Combustor cans 26 collectively discharge their combustion gas streams into a common plane at turbine section 28 (shown in FIG. 1). A plurality of main fuel nozzles 220 are spaced circumferentially within annulus 212 to premix the main fuel with a portion of the air exiting diffuser 218 and to supply the fuel and air mixture to combustor 26. A plurality of main fuel supply conduits 222 supply fuel to main nozzles 220. A plurality of pilot fuel nozzles 226 supply pilot fuel to combustor 26 with a plurality of pilot fuel supply conduits 228 distributing fuel to pilot fuel nozzles 226. A plurality of igniters (not shown) may be positioned within the vicinity of pilot fuel nozzles 226 to ignite fuel supplied to pilot fuel nozzles 226.

A combustion sensor 230 may be positioned within combustor 26 to monitor pressure and/or flame fluctuations therein. Sensor 230 transmits signals indicative of combustion conditions within combustor can 26 to on-line gas turbine engine control system 202 that communicates with a fuel controller 234 that adjusts pilot fuel and main fuel flow rates to combustor 26 and with an air controller 236 that may control engine air control dampers (not shown).

Different gas turbine combustion engines may have different numbers of combustor cans. For example, power generation gas turbine engines may include can combustors with six (6), twelve (12), fourteen (14), eighteen (18) or twenty-four (24) cans provided in a linear configuration, radial configuration or other consecutive arrangement. Several examples presented herein make reference to 18-can configurations, although it should be appreciated that this is not an unnecessarily limiting feature. More of less than such exemplary numbers of cans can be utilized.

Figure 3:
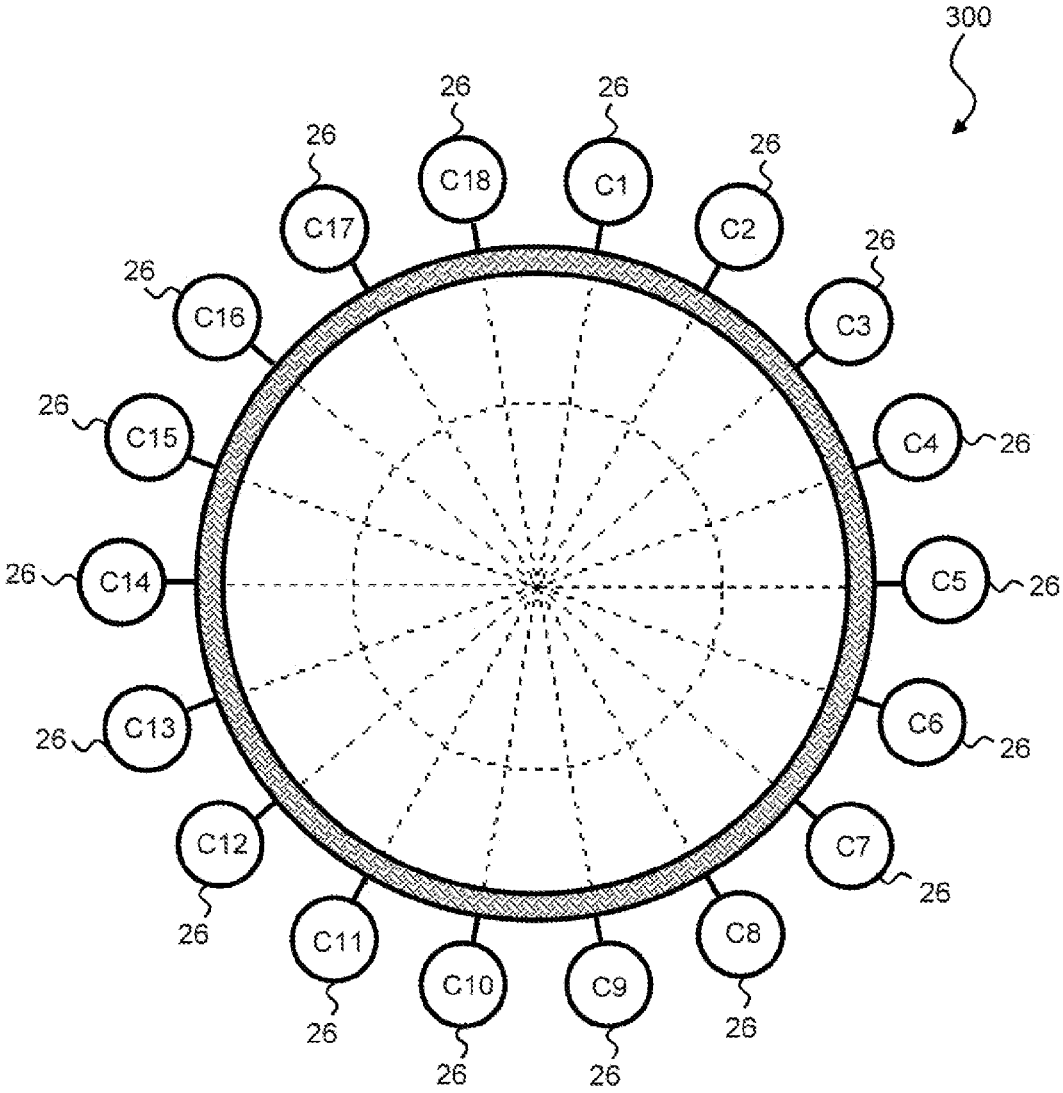
FIG. 3 PRIOR ART
FIG. 3 is a schematic representation of an exemplary radial arrangement of prior art combustor cans within a gas turbine engine.

FIG. 3 provides a schematic representation of an 18-can configuration for use in a combustion engine. In this particular example, the cans 26 (each of which are respectively labeled as C1, C2, . . . , C18) are generally symmetrical around a longitudinal or axial centerline axis of the engine. Each combustor can generally includes a head end, a combustor liner and an integral transition piece (not shown). The transition piece outlets of each combustor can 26 from the corresponding combustor cans adjoin each other around the perimeter of the combustor to collectively discharge their separate combustor streams into a common planar location (e.g., a common single turbine nozzle). FIG. 3 is labeled as prior art because it does not include integrated resonator features of the present invention, although the general components discussed relative to FIG. 3 also apply to the cans of FIGS. 4-6 (e.g., the characteristics of a head end, combustor liner, integral transition piece, etc.)

Since the several combustor cans collectively discharge their respective gas streams into the common turbine nozzle, the potential for undesirably high levels of dynamic interaction of the circumferentially adjacent streams may exist. For example, combustion of the fuel and air mixture in the corresponding combustion gas streams can create both static pressure, and dynamic pressure represented by periodic pressure oscillations in the streams. The periodic pressure oscillations are frequency specific and vary in magnitude from zero for non-resonant frequencies to elevated pressure amplitudes for resonant frequencies. As described in further detail below, dynamic interaction of the adjacent gas streams is preferably mitigated by suppressing the out-of-phase dynamic interaction of the streams discharged from the cans, which corresponds with the push-pull dynamic modes. In addition, in-phase dynamic interaction is addressed by reducing the coherence of push-push tones. Improvements in the levels of dynamic interaction are generally intended to enhance combustor performance while simultaneously reducing or eliminating fatigue damage therefrom.

The undesirable push-pull mode of dynamic interaction may be characterized as alternating plus and minus phase relationship between any two adjoining cans. Dynamic modes are frequency specific with corresponding periodic pressure oscillations which are sinusoidal waveforms. The peaks of the waveforms may be considered the positive or plus (+) value, with the troughs or valleys being the corresponding minus (−) values. When adjoining combustor cans dynamically interact in the push-pull mode, the plus value in one can is in phase with the minus value in an adjacent can at a corresponding frequency. When adjoining combustor cans dynamically interact in the push-push mode, the plus value in one can is in phase with the plus value in an adjacent can at a corresponding frequency.

Empirical test data for a conventional multi-can combustor indicates a push-pull mode of dynamic interaction at about a first frequency, with the next resonant mode of interaction being a push-push mode at a higher second frequency. The amplitude of pressure oscillation substantially decreases with an increase in frequency mode. In one exemplary combustor configuration having 18 cans, the first resonant frequency at which push-pull dynamic interaction from pressure oscillations occur at about a first frequency, while the second resonant frequency at which a push-push mode causes high combustion dynamics is at a second higher frequency. Since both the push-pull and push-push dynamic interaction requires specific out-of-phase or in-phase correspondence from can to can, resonators may be used in accordance with the disclosed technology to prevent continuity of the respective occurrences of in-phase and out-of-phase interaction.

In general, advantages of the presently disclosed resonator assemblies for integrated application within a combustor engine are achieved by coupling a plurality of resonators to selected cans within the combustor engine. The resonators serve as passive devices to control combustion dynamics by reducing the energy content from unstable modes (such as the push-pull and push-push modes at first and second respective resonant frequencies) to two different frequencies above and below each original instability. The idea is to ensure that the instability frequency due to pressure oscillation peaks in each can is different compared to the adjacent can, thus making it possible to break the physical interaction between the cans at a particular frequency. Such mismatch in frequencies in adjacent cans reduces the coherence between adjacent cans and thus eliminates the perfect push-push tones that are a concern for the turbine buckets and other components within a gas turbine engine. In addition, the mismatch in impedance at the cross-talk area will provide damping for the push-pull tones.

Figure 4:
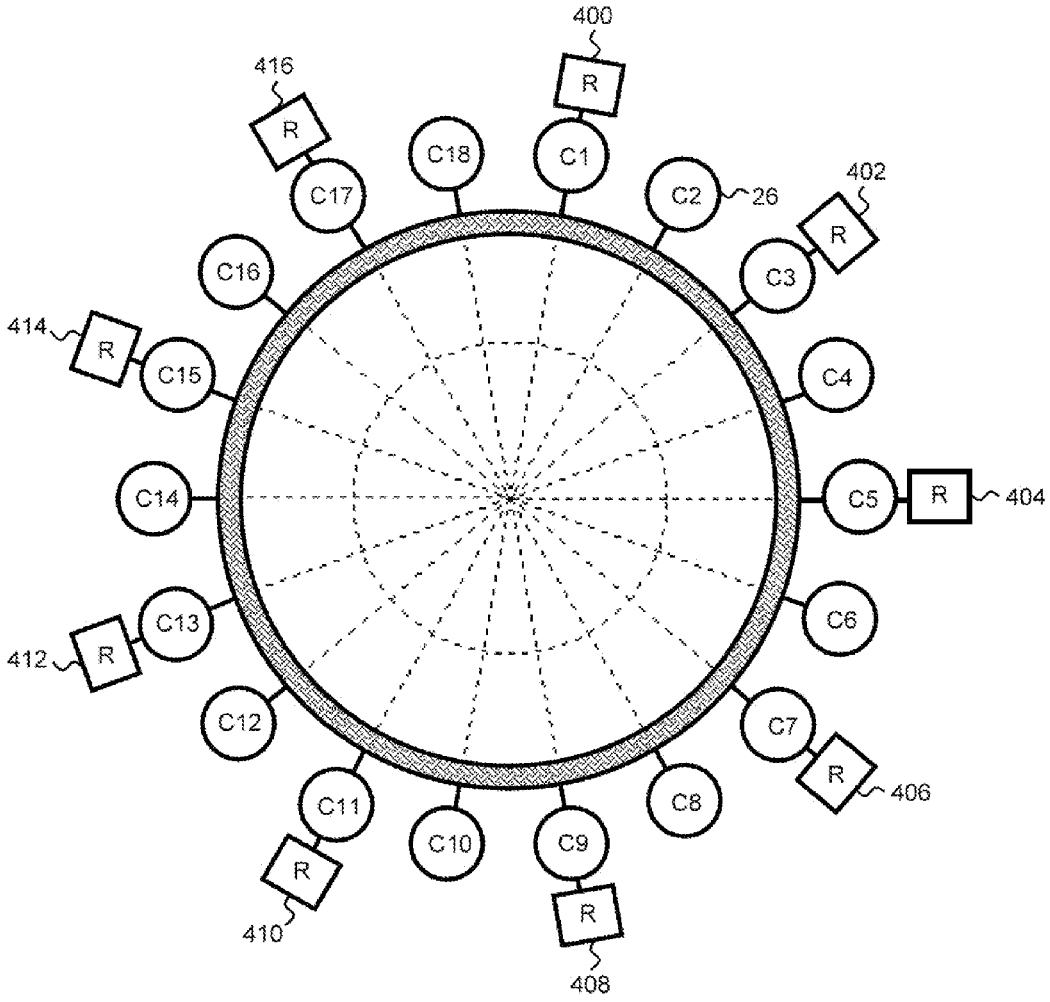
FIG. 4 is a schematic representation of an exemplary radial arrangement of combustor cans within a gas turbine engine, including a first exemplary arrangement of corresponding resonators coupled thereto for suppression of combustion dynamics.
Figure 5:
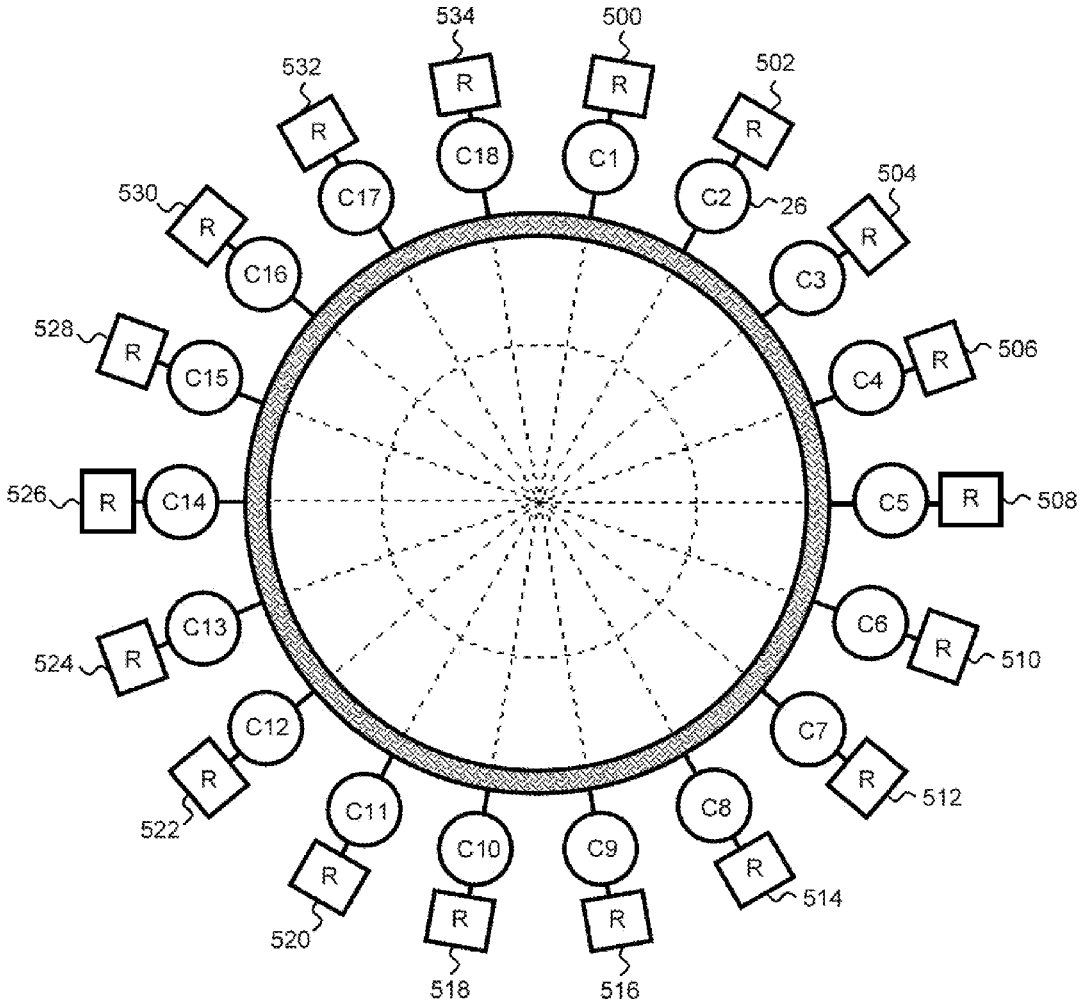
FIG. 5 is a schematic representation of an exemplary radial arrangement of combustor cans within a gas turbine engine, including a second exemplary arrangement of corresponding resonators coupled thereto for suppression of combustion dynamics
Figure 6:
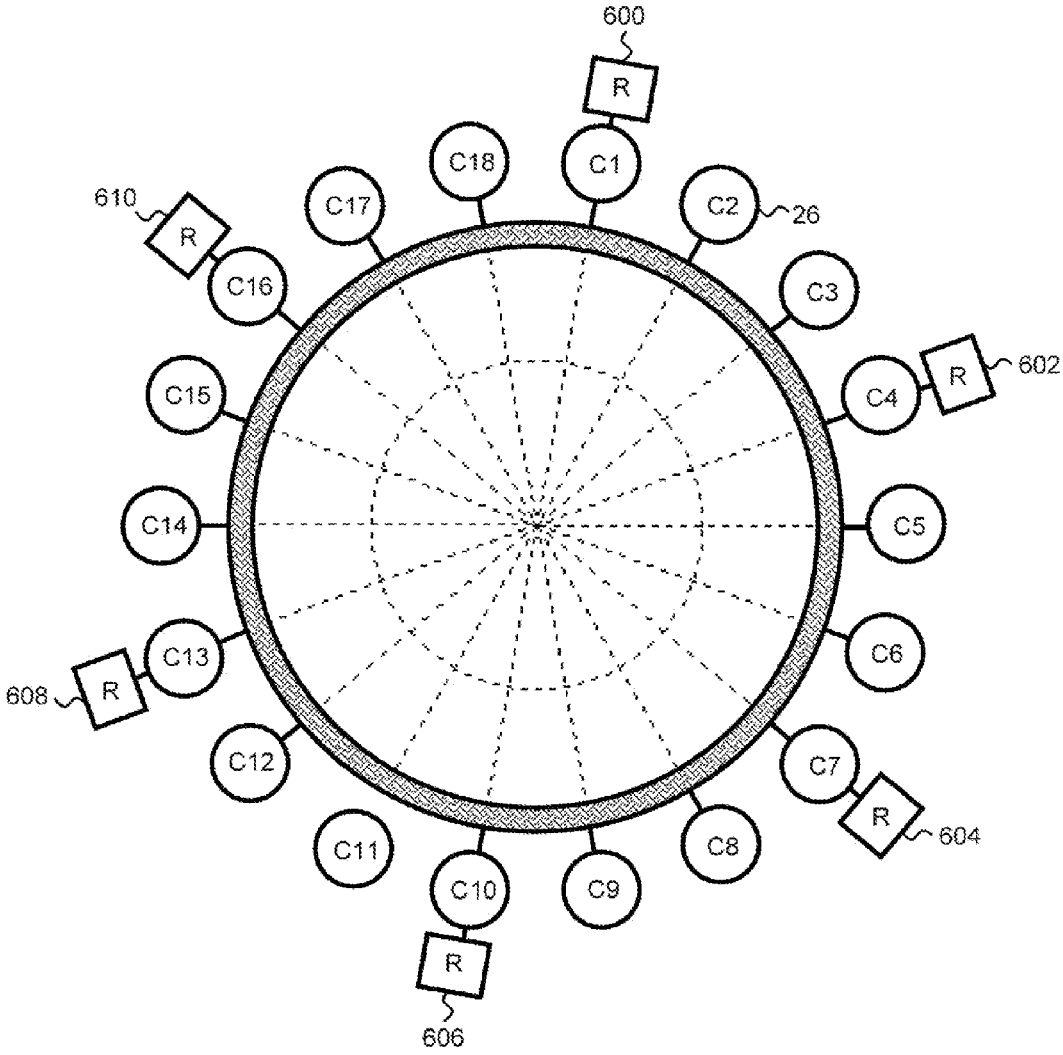
FIG. 6 is a schematic representation of an exemplary radial arrangement of combustor cans within a gas turbine engine, including a third exemplary arrangement of corresponding resonators coupled thereto for suppression of combustion dynamics.

FIGS. 4, 5 and 6 provide schematic diagrams of three exemplary multi-can combustor arrangements having resonators selectively coupled to the combustor cans in order to achieve desirable acoustic absorption and frequency splitting effects. Such examples are provided to show exemplary resonator placement within an eighteen-can combustor, although it should be appreciated that the number of cans and corresponding resonators should not be an unnecessarily limiting aspect of the disclosed technology. The general nature of such configurations (e.g., resonators on every can, every other can, every third can, etc. in a consecutive arrangement of cans) can be applied to combustors having different total numbers of cans, namely 6, 12, 24, and others. In addition, some embodiments may include more than one resonator applied to each can or to selective groupings of cans, where different resonators on a given van are tuned to the same or difference resonant frequencies.

In addition, when resonators are discussed herein as being tuned for operation at specific frequency levels corresponding to the resonant frequencies of an 18-can combustor engine, this too should not be limiting. Resonators can be designed for operation at any selected frequency by careful choice of design criteria relating to the length, shape and overall volume of a resonator cavity. Determining which frequencies must be attenuated is usually done by a combination of past experience, empirical and semi-empirical modeling, and by trial and error. For example, in tube-based resonators, designing the characteristic length L is very important and is best accomplished using semi-empirical methods well known in the art to determine the wavelength of the acoustic pressure oscillations which are to be attenuated. In open-ended tube resonators, the characteristic length L is determined as $L=C/2f$, and for closed-end tube resonators, the characteristic length L is determined as $L=C/4f$, where f=oscillation frequency (Hz), C=Acoustic speed of sound in air contained within the tube, in ft/sec, and L=Characteristic Length, in ft.

The location of each resonator relative to the components of a combustor can may also be varied in accordance with the presently disclosed arrangements depending on the frequency at which each resonator is designed to operate. In particular, an end of each resonator may be coupled to a particular location along the head end, liner, transition piece or other specific portion of each combustor can. In one example, it has been determined that a resonator configured to provide pressure damping at frequencies around a particular frequency instability is generally well-suited for placement at the exit of a combustor can near the transition piece.

Referring now to the particulars of FIGS. 4-6, FIG. 4 shows one exemplary embodiment of a multi-can combustor arrangement having eighteen cans 26, numbered C1, C2, . . . , C18. Resonators 400-416, respectively, are coupled to selected ones of the combustor cans 26. As shown in FIG. 4, resonator 400 is coupled to can C1, resonator 402 is coupled to can C3, resonator 404 is coupled to can C5, resonator 406 is coupled to can C7, resonator 408 is coupled to can C9, resonator 410 is coupled to can C11, resonator 412 is coupled to can C13, resonator 414 is coupled to can C15 and resonator 416 is coupled to can C17. As such, at least one resonator is coupled to each alternating can in the consecutive multi-can arrangement such that only one can in each adjacent pair includes a resonator.

Referring still to FIG. 4, one exemplary embodiment of such multi-can combustor comprises resonators 400-416, respectively, each tuned to the same frequency of operation. For example, all such resonators may be tuned to provide acoustic damping at either the first or second resonant frequencies for combustion cans. In another example, a first group of selected cans 26 are outfitted with resonators tuned to suppress oscillations at a first frequency, and wherein the resonators coupled to a second group of selected cans are tuned to suppress oscillations at a second frequency. Such first and second frequencies may correspond to the resonant frequencies as discussed above or some other selected variation that is effective to decouple the pressure oscillations in adjacent cans. These specific examples of first and second frequencies equally apply to the additional embodiments discussed below with respect to FIGS. 5 and 6.

FIG. 5 shows another exemplary embodiment of a multi-can combustor arrangement having eighteen cans 26, numbered C1, C2, . . . , C18. Resonators 500-532, respectively, are provided such that each combustor can 26 has a corresponding resonator (R) coupled thereto. As shown in FIG. 5, resonator 500 is coupled to can C1, resonator 502 is coupled to can C2, resonator 504 is coupled to can C3, resonator 506 is coupled to can C4, resonator 508 is coupled to can C5, resonator 510 is coupled to can C6, resonator 512 is coupled to can C7, resonator 514 is coupled to can C8, resonator 516 is coupled to can C9, resonator 518 is coupled to can C10, resonator 520 is coupled to can C11, resonator 522 is coupled to can C12, resonator 524 is coupled to can C13, resonator 526 is coupled to can C14, resonator 528 is coupled to can C15, resonator 530 is coupled to can C16, resonator 532 is coupled to can C17, and resonator 534 is coupled to can C18. As such, at least one resonator is coupled to every can in the consecutive multi-can arrangement.

Referring still to FIG. 5, one exemplary embodiment of such multi-can combustor comprises a first group of selected cans 26 tuned to suppress oscillations at a first frequency and a second group of selected cans 26 tuned to suppress oscillations at a second frequency. In a more particular embodiment, the first group comprises a number of cans equal to half the total number in the plurality of consecutively arranged combustor cans and corresponds to every other can in the consecutive arrangement. The second group comprises a number of cans equal to half the total number in the plurality of consecutively arranged cans and corresponds to the remaining cans in the consecutive arrangement. Such first and second groupings may be configured, for example, as a first group of cans corresponding to all even-numbered cans (C2, C4, . . . , C18) and the second group of cans corresponding to all odd-numbered cans (C1, C3, . . . , C17) in a consecutive arrangement of cans 26.

Another exemplary embodiment of the multi-can combustor assembly shown in FIG. 5 is configured such that the resonators 500-534, respectively are tuned at staggered frequency levels within a range of frequency values to provide a variety of offset in the resultant split frequencies of each can in the collective grouping. For example, one embodiment may be configured such that each resonator is tuned to a different frequency within a range, starting at a lowest frequency and increasing in frequency value at fixed or random increments tip to a highest frequency. Alternatively, the incremental tuning of resonators may be staggered in a different predetermined fashion across the combustor cans 26.

In a still further embodiment, not every resonator is configured to operate at a different frequency, but a sufficient level of variety is provided such that resonators are tuned to more frequencies than simply first and second resonator frequencies as already described above. For example, consecutive cans may be respectively coupled to resonators tuned for operation at first, second and third frequencies with this sequence repeating itself. Fourth, fifth, sixth or other frequencies may also be introduced into the periodic, alternating or other predetermined pattern of frequency assignment.

Referring now to FIG. 6, yet another exemplary embodiment of an 18-can combustor arrangement having decoupling resonators in accordance with aspects of the present invention is illustrated schematically. As shown in FIG. 6, resonator 600 is coupled to can C1, resonator 602 is coupled to can C4, resonator 604 is coupled to can C7, resonator 606 is coupled to can C10, resonator 608 is coupled to can C13, and resonator 610 is coupled to can C16. As such, at least one resonator is coupled to each third can in the consecutive multi-can arrangement. In one example, each resonator 600-610, respectively, is tuned to the same frequency of operation. In another example, different frequency levels are selectively chosen for different resonators.

Figure 7:
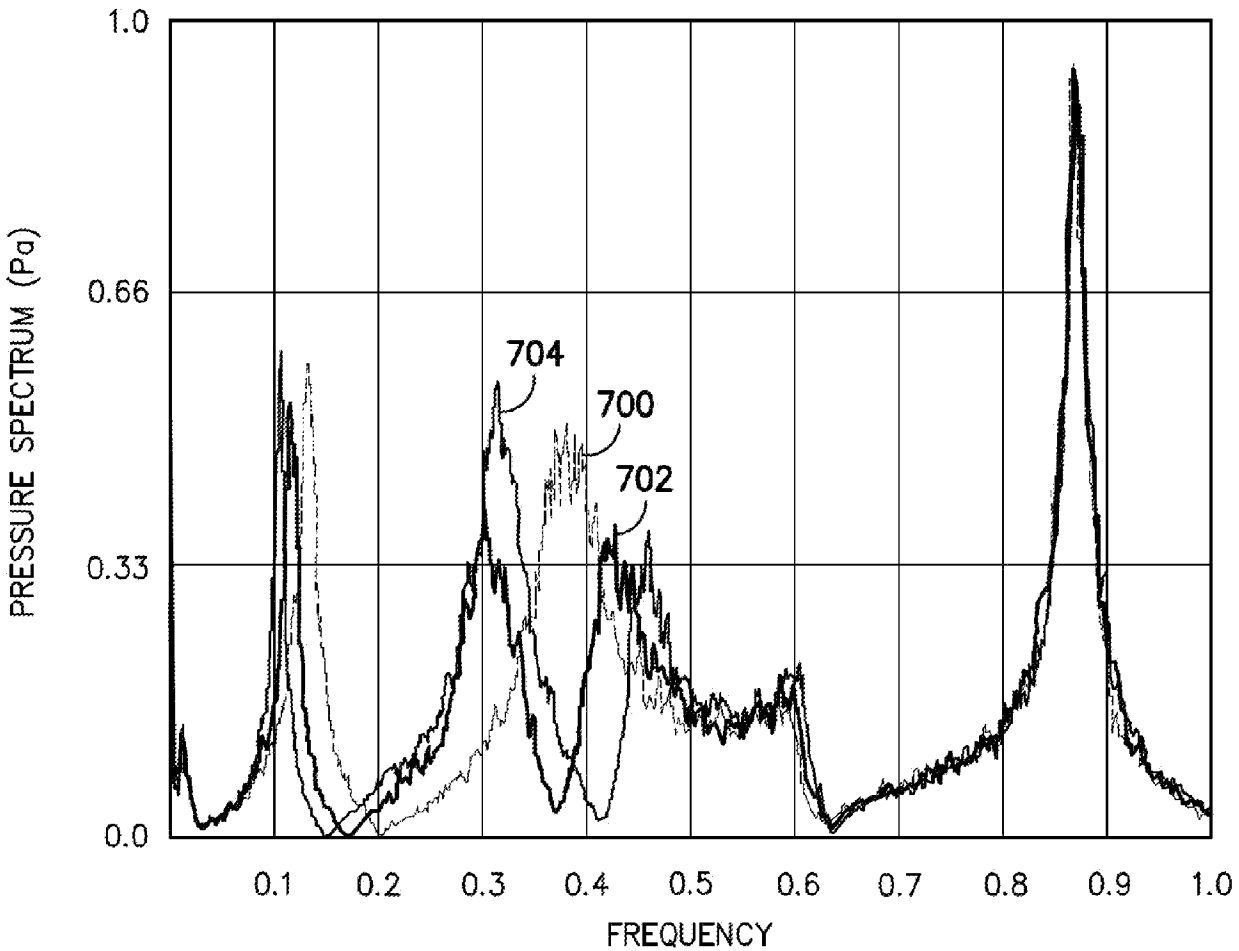
FIG. 7 is an exemplary graphical representation of simulated pressure spectrum values (normalized over a range from 0 to 1) versus frequency (also normalized over a range from 0 to 1) for a turbine engine combustor can operating in three states—without a resonator, with a first exemplary resonator coupled thereto, and with a second exemplary resonator coupled thereto.
Figure 8:
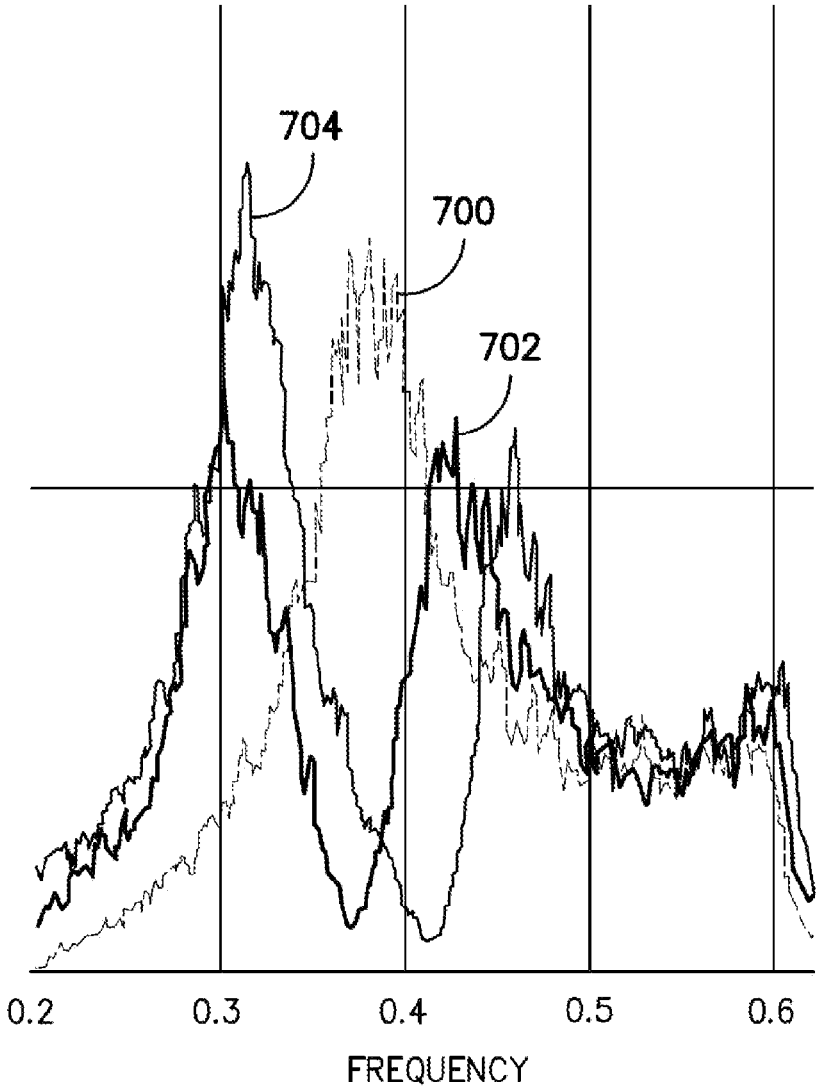
FIG. 8 is a magnified view of the pressure versus frequency graphical representation of FIG. 8 in a normalized frequency range from about 0.2 to 0.6.

FIGS. 7 and 8 show the effects of how a resonator applied to a given combustor can accomplish desirable frequency-splitting effects in accordance with exemplary embodiments of the present invention. In particular, FIG. 7 provides an exemplary graphical representation of simulated pressure spectrum values (normalized over a range from 0 to 1) versus frequency (normalized over a range from 0 to 1) for a given turbine engine combustor can operating in three states. FIG. 8 shows a magnified view of the same pressure versus frequency plot in a normalized frequency range from about 0.2 to 0.6. FIGS. 7 and 8 show a first plot 700 of exemplary simulated pressure values versus frequency for a combustor can under normal operating conditions (i.e., without a resonator). Three specific pressure oscillation peaks are evident from plot 700. In particular, a first occurrence of peak pressure levels arises at a first resonant frequency indicated near the 0.12-0.14 range. A second occurrence of peak pressure levels arises at a second resonant frequency within a range from about 0.34-0.4. A third occurrence of peak pressure levels arises at a third resonant frequency within a range from about 0.84-0.88. Exemplary embodiments of the present invention seek to address the instabilities at the first and second resonant frequencies as opposed to the high-frequency instabilities, such as those in the 400 Hz range and beyond.

Referring still to FIGS. 7 and 8, plots 702 and 704 show simulated effects of pressure changes in combustor can operation when two different exemplary resonator assemblies are employed. Such resonator assemblies comprise first and second variations of exemplary Helmholtz resonators designed to provide acoustic pressure damping at a frequency matching a first resonant frequency of instability. As shown in plot 702, the first exemplary resonator is effective not only to decrease the peak amplitude of the pressure oscillations, but to split the peak frequency from about 0.36 to two peak frequencies having center frequencies of about 0.3 and 0.42. As shown in plot 704, the second exemplary resonator is effective to split the peak frequency from about 0.36 to two peak frequencies at about 0.32 and 0.46, respectively.

In one example of a combustor can exhibiting dynamic instabilities at a given frequency measured in Hertz, an exemplary resonator may be effective to split the pressure peak that originally occurred at the given frequency to two or more separate pressure peaks occurring at respective new frequencies. For example, one of the resultant pressure peaks (after being split by a resonator) may have a maximum level at a first new frequency within a range from about five (5) to about thirty (30) Hz below the original resonant frequency of instability while the other resultant pressure peaks (after being split by a resonator) may have a maximum level at a second new frequency within a range from about five (5) to about thirty (30) Hertz below the original resonant frequency. In another example, the first and second new frequencies are within a range from about fifteen (15) to twenty (20) Hertz respectively above and below the original resonant frequency.

Simulated data showing exemplary effects of such frequency splitting applied across multiple cans in a combustor engine (such as might be achieved with an embodiment of the invention selected from those depicted in FIGS. 4-6) are illustrated in FIGS. 11-12 and 15-16. Such effects are compared with simulated data of FIGS. 9-10 and 13-14 showing exemplary effects when no such frequency splitting is employed (such as might be seen in a conventional combustor engine as depicted in FIG. 3).

Figure 9:
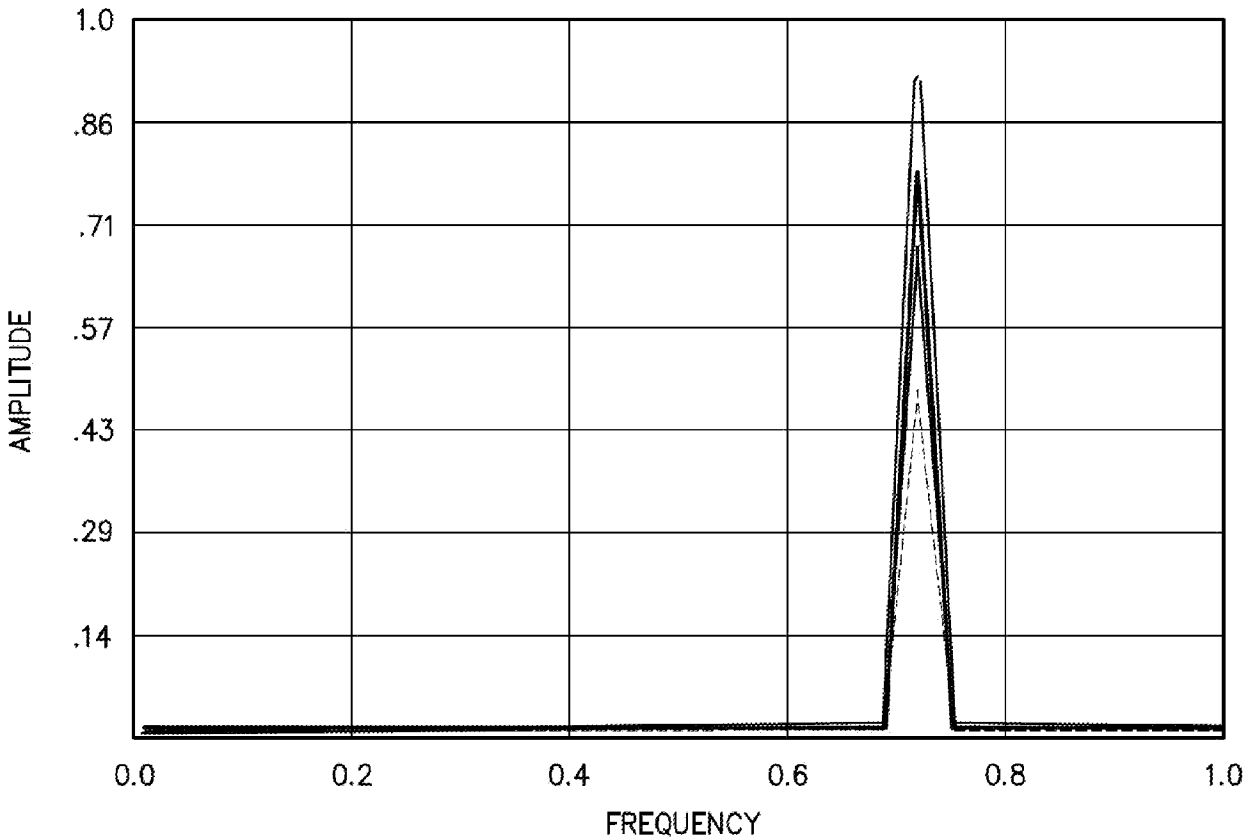
FIG. 9 is an exemplary graphical representation of simulated pressure amplitude (normalized over a range from 0 to 1) versus frequency (also normalized over a range from 0 to 1) for eighteen (18) exemplary cans in a gas turbine combustor engine, such as shown in FIG. 3.
Figure 10:
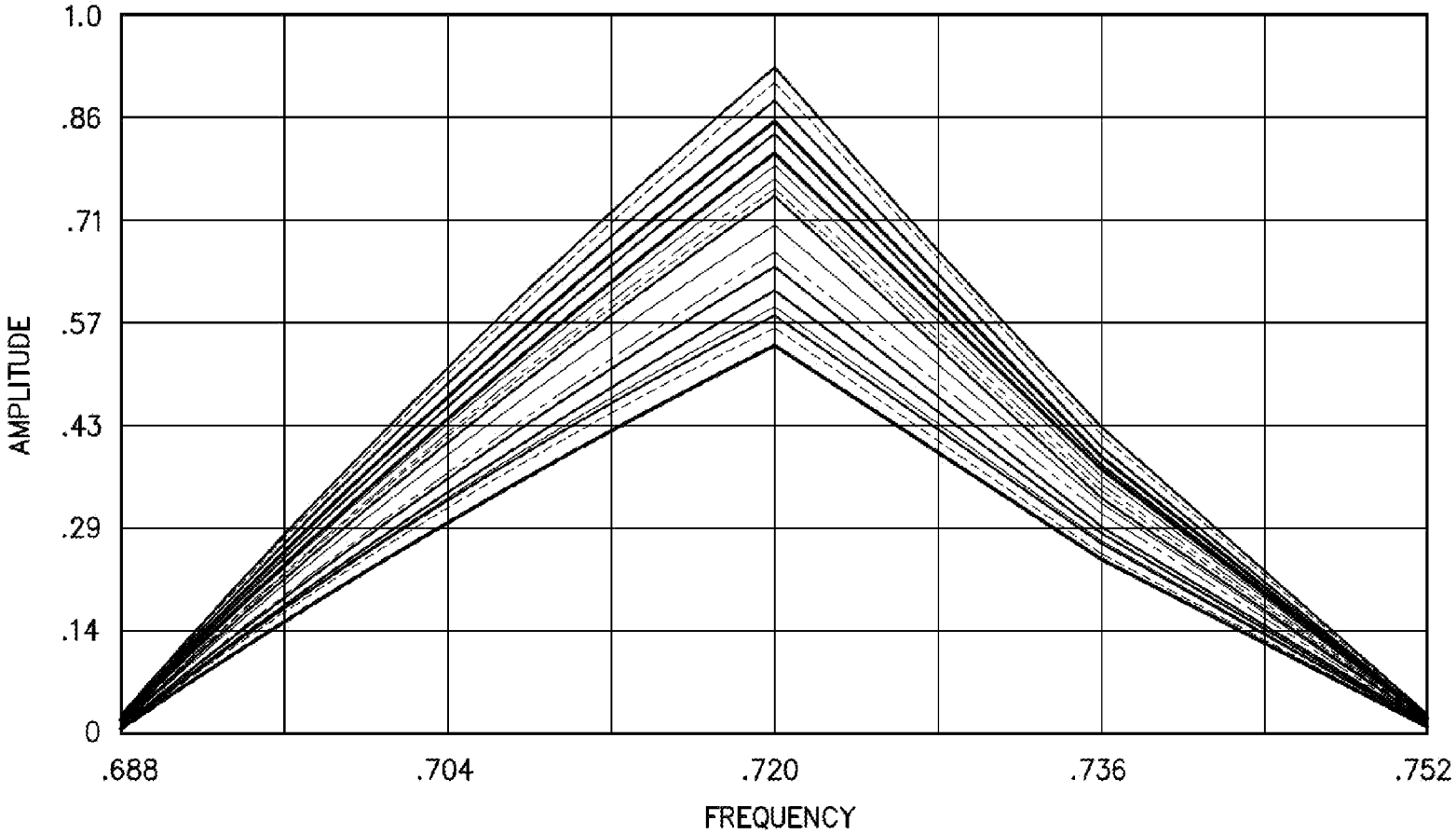
FIG. 10 is a magnified view of the pressure versus frequency graphical representation of FIG. 9 in a normalized frequency range from about 0.688 to 0.752.

FIGS. 9 and 10 show exemplary simulated pressure values versus frequency when all cans in an 18-can combustion engine (like that depicted in FIG. 3) exhibit peak resonant frequencies at a given frequency (indicated at a normalized value of about 0.72. Normalized frequency levels are plotted across the abscissa, while normalized pressure amplitude is plotted across the ordinate of such graphs. As seen in such graphs, especially the magnified view of FIG. 10, all cans are unstable based on peak pressure oscillation at a normalized frequency of about 0.72.

Figure 13:
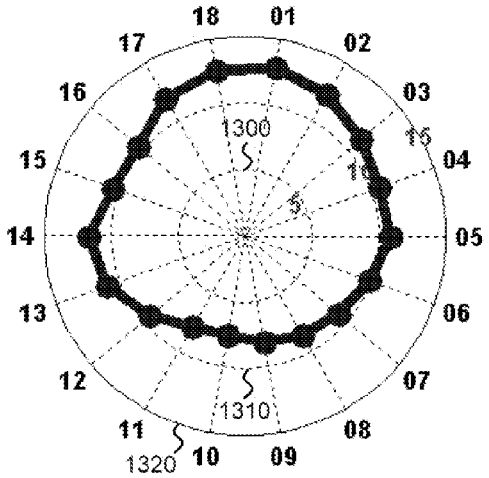
FIG. 13 is an exemplary graphical representation of exemplary pressure levels in each can of an 18-can gas turbine combustor engine such as shown in FIG. 3 when operating at a first given frequency level.
Figure 14:
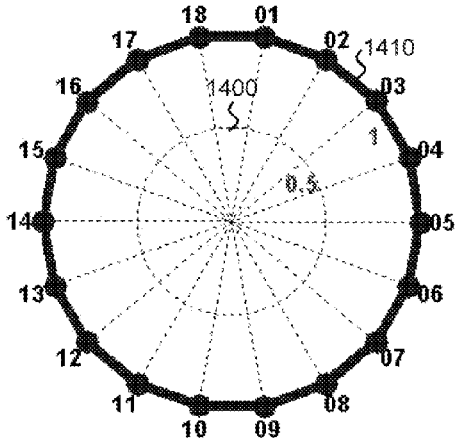
FIG. 14 is an exemplary graphical representation of exemplary coherence levels for each can in an 18-can gas turbine combustor engine such as shown in FIG. 3, with coherence measured with respect to can 1 when operating at a first given frequency level.

The potential for high dynamics exhibited across a collective assembly of multiple cans within a combustor engine operating with the resonant frequencies shown in FIGS. 9 and 10 can be seen in FIGS. 13 and 14.

FIG. 13 provides a graphical view of exemplary pressure levels in each can of an 18-can gas turbine combustor engine such as shown in FIG. 3 when operating at a the first given resonant frequency. The pressure levels are measured outward from the center of the radial graph starting at a center amplitude of zero. Radial line 1300 corresponds to a pressure level of about 5 psi, radial line 1310 corresponds to a pressure level of about 10 psi, and radial line 1320 corresponds to a pressure level of about 15 psi. As seen from FIG. 13, the amplitude in each can is at a relatively high level resulting in a mean amplitude (μ) of about 10 psi with a standard deviation (a) of about 1.6. For conversion purposes, 1 psi=6894.75 Pascals (Pa) or $N/m^2$.

FIG. 14 provides a graphical view of exemplary coherence values in each can for each can in an 18-can gas turbine combustor engine such as shown in FIG. 3, with coherence measured with respect to can 1 when operating at a first resonant frequency. Coherence values such as plotted in FIG. 14 are generally determined by the following formula:

$$C_{xy}(f) = \frac{|P_{xy}(f)|^2}{P_{xx}(f)P_{yy}(f)},$$

where $C_{xy}(f)$ is the squared coherence magnitude between first can x and second can y, $P_{xy}(f)$ is the cross-power spectral density of x and y, $P_{xx}(f)$ is the power spectral density of x, and $P_{yy}(f)$ is the power spectral density of y. Coherence values are measured outward from the center of the radial graph starting at a center value of zero and extending to first radial line 1400 indicating a coherence of 0.5 to a second radial line 1410 indicating a coherence of about 1.0. The coherence values in this particular arrangement are as high as possible at 1.0 in each can with respect to can 1. High coherence values indicate an increased potential for undesirable combustion dynamics exhibited by the push-push tones across adjacent cans.

Figure 11:
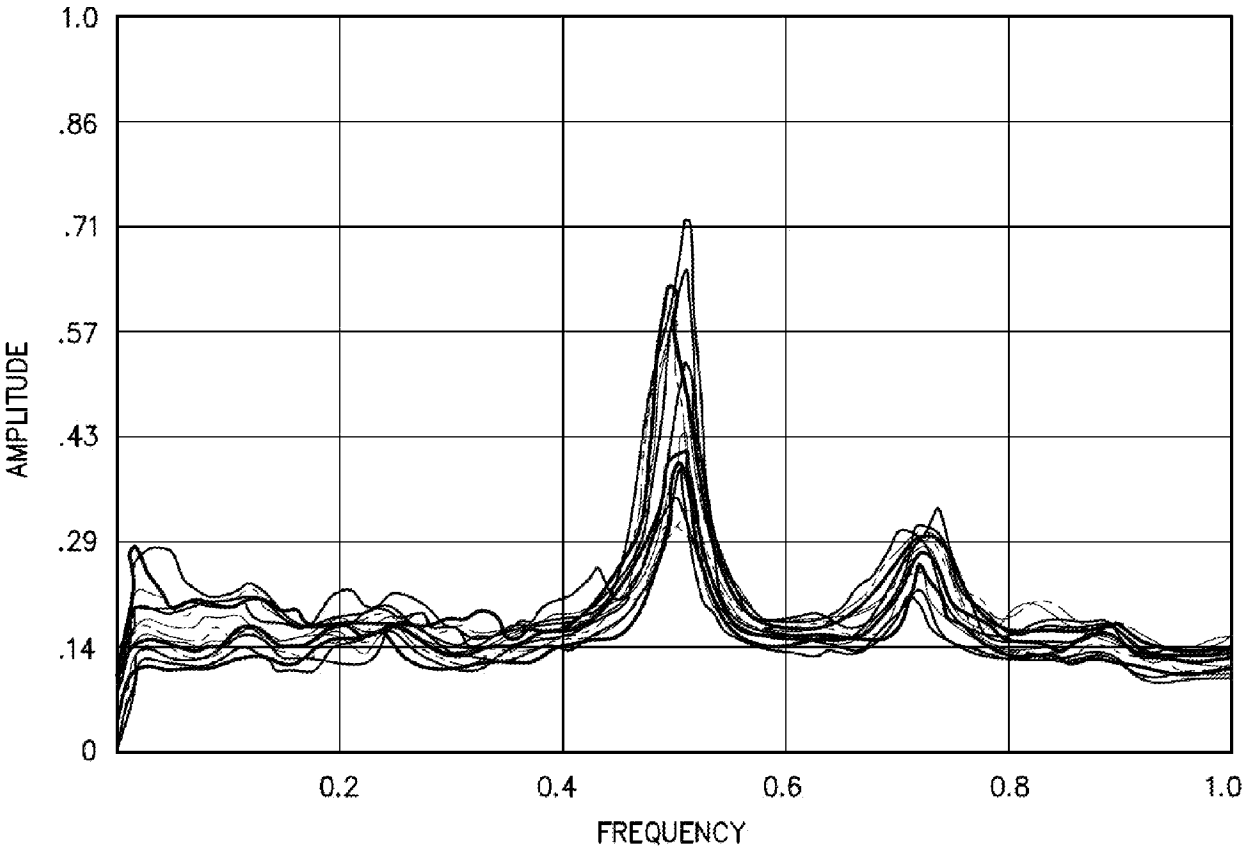
FIG. 11 is an exemplary graphical representation of simulated pressure amplitude (normalized over a range from 0 to 1) versus frequency (also normalized over a range from 0 to 1) for eighteen (18) exemplary cans in a gas turbine combustor engine with frequency splitting such as might be accomplished with a disclosed resonator assembly.
Figure 12:
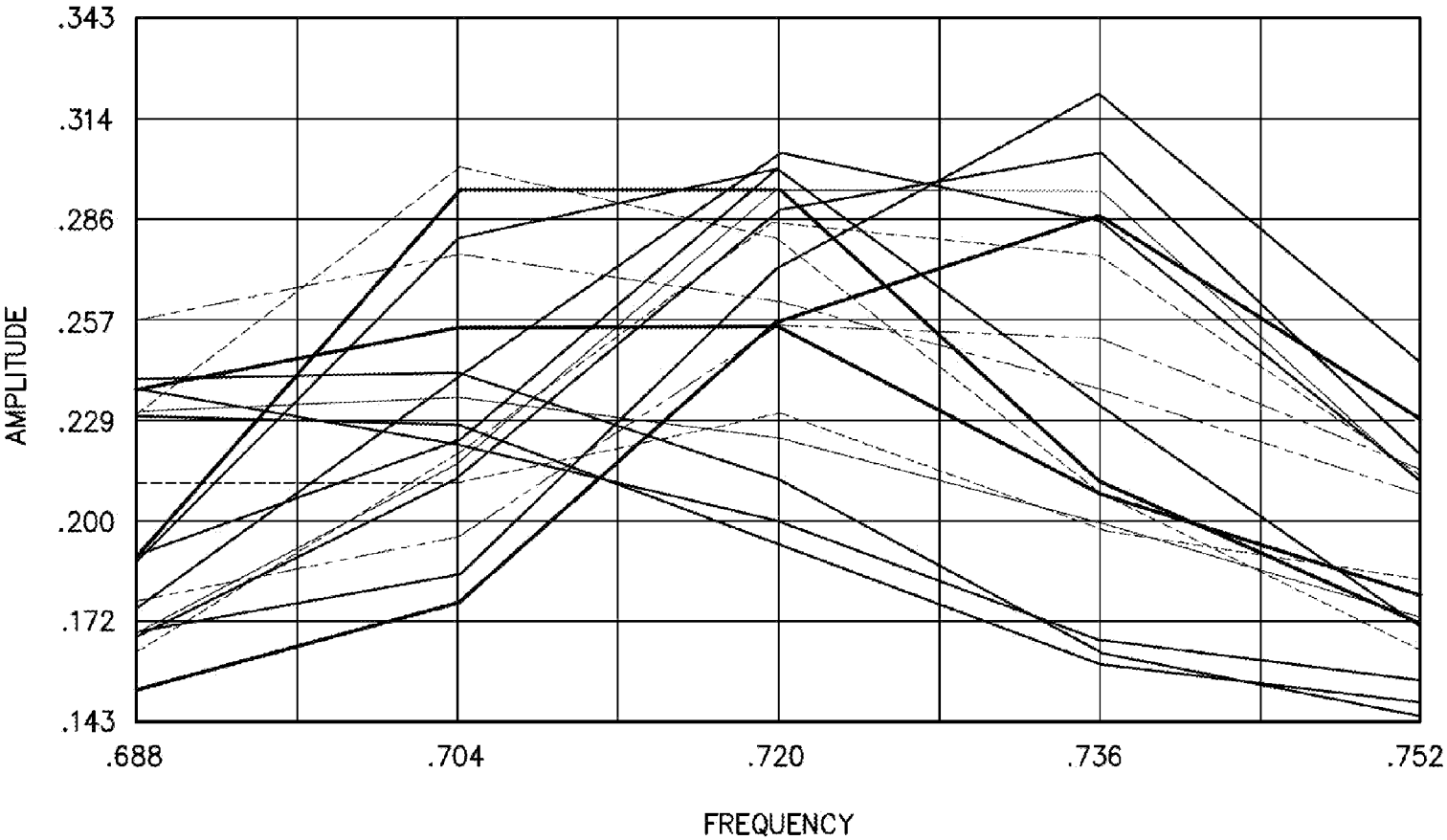
FIG. 12 is a magnified view of the pressure versus frequency graphical representation of FIG. 11 in a normalized frequency range from about 0.688 to 0.752.

Comparative advantages as might be achieved when resonator assemblies are provided in accordance with aspects of the present invention are illustrated in FIGS. 11-12 and 15-16. FIG. 11 is an exemplary graphical representation of simulated pressure amplitude (normalized over a range from 0 to 1) versus frequency (also normalized over 0 to 1) for eighteen (18) exemplary cans in a gas turbine combustor engine when the frequencies are shifted from the peaks shown in FIGS. 9-10. The simulated plots in FIGS. 11-12 may not display all aspects of actual resonator effects (e.g., the dual peak frequency splitting as seen in FIGS. 7 and 8), but the general nature of the frequency shifts shown in FIGS. 11-12 are sufficient to provide comparative data for examining the resultant effects on pressure amplitude and coherence at resonant frequencies of interest.

Figure 15:
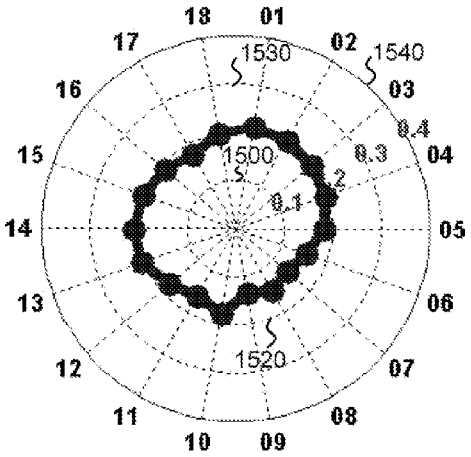
FIG. 15 is an exemplary graphical representation of exemplary pressure levels in each can of an 18-can gas turbine combustor engine operating at a first given frequency level when frequency splitting such as might be accomplished with a disclosed resonator assembly is employed.
Figure 16:
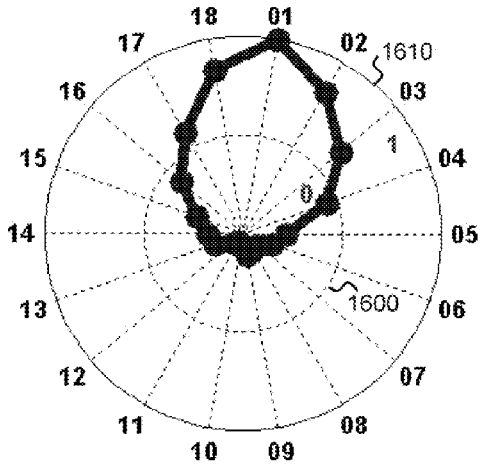
FIG. 16 is an exemplary graphical representation of exemplary coherence levels for each can in an 18-can gas turbine combustor engine operating at a first given frequency level and with coherence measured with respect to can 1, when frequency splitting such as might be accomplished with a disclosed resonator assembly is employed.

FIGS. 15 and 16 provide a graphical view of exemplary pressure levels in each can of an 18-can gas turbine combustor engine having performance curves as shown in FIGS. 11 and 12. FIG. 15 is a radial plot of the frequency level in each of the 18 cans when operating at a first given frequency. The pressure levels are measured outward from the center of the radial graph starting at a center amplitude of zero. Radial line 1510 corresponds to a pressure level of about 0.1 psi, radial line 1520 corresponds to a pressure level of about 0.2 psi, radial line 1530 corresponds to a pressure level of about 0.3 psi, and radial line 1540 corresponds to a pressure level of about 0.4 psi. As seen from FIG. 15, the amplitude in each can is at a relatively low level compared to the levels in FIG. 13, resulting in a mean amplitude (μ) of about 0.1 psi with a negligible amount of standard deviation (σ).

Improved coherence levels are also achieved as seen by comparing FIGS. 14 and 16. In FIG. 16, coherence values are measured outward from the center of the radial graph starting at a center value of zero and extending to first radial line 1600 indicating a coherence of 0.5 to a second radial line 1610 indicating a coherence of about 1.0. The coherence values in this particular arrangement are much lower than those from FIG. 14, with FIG. 16 values exhibiting a mean coherence of about 0.34 and a standard deviation of about 0.30.

A particular advantage of selected embodiments disclosed above is that the resonator and combustor can arrangements may be readily adaptable into a pre-existing power generation turbine. Selective arrangement and tuning of the disclosed resonator assemblies is configured to reduce relatively high combustion dynamics by both absorbing acoustic energy and by changing the frequency levels among adjacent cans. In particular, by selectively tuning passive resonators selectively distributed among combustor cans in a multi-can combustor, it is possible to achieve an operational arrangement in which frequencies of instability in each can are different from adjacent cans. This decoupling reduces the potential for high combustion dynamics in the push-push and/or push-pull modes.

The present design also offers advantages in that emissions performance of a gas turbine engine may also be improved. In particular, the dynamic pressure oscillations in all combustion chambers may be controlled within acceptable limits while simultaneously minimizing the total emissions (e.g., of nitrous oxide) produced by the sum of all chambers. Given that the emissions levels, dynamic pressure oscillations, and temperature of exhaust gases often vary as a function of fuel delivered, overall engine efficiency can be further tuned and optimized (e.g., relative to conditions referred to as "even splits" of such parameters) by affording more design space in accordance with the reduced dynamics of the presently disclosed technology.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A method for suppressing the dynamic interaction among combustor cans in a gas turbine combustion engine, said method comprising the steps of:

providing a plurality of consecutively arranged combustor cans for generating respective streams of combustion gases therein and collectively discharging the streams of combustion gases, the combustor cans defining a first group and a second group;

providing a plurality of resonators, a first plurality of resonators coupled to the first group of combustor cans in the plurality of consecutively arranged combustor cans and a second plurality of resonators coupled to the second group of combustor cans; and selectively tuning the first plurality of resonators to suppress oscillations at a first frequency and tuning the second plurality of resonators to suppress oscillations at a second frequency different from the first frequency, such that one or more of out-of-phase and in-phase dynamic interactions of the streams discharged from adjacent combustor cans in the plurality of consecutively arranged combustor cans are suppressed.

2. The method of claim 1, wherein the first group comprises a number of combustor cans equal to half the total number in the plurality of consecutively arranged combustor cans and corresponds to every other can in the consecutive arrangement, and wherein the second group comprises a number of combustor cans equal to half the total number in the plurality of consecutively arranged combustor cans and corresponds to the remaining combustor cans in the consecutive arrangement not in said first group.

3. The method of claim 1, wherein the number of combustor cans is one of six, twelve, eighteen, and twenty-four combustor cans.

4. A method for suppressing the dynamic interaction among combustor cans in a gas turbine combustion engine, said method comprising the steps of:

providing a plurality consecutively arranged combustor can for generating respective streams of combustion gases therein and collectively discharging the streams of combustion gases;

providing a plurality of resonators, wherein at least one resonator is coupled to selected combustor cans in the plurality of consecutively arranged combustor cans, the selected combustor cans consisting of every other combustor can in the plurality of consecutively arranged combustor cans; and selectively tuning the plurality of resonators to suppress one or more of out-of-phase and in-phase dynamic interactions of the streams discharged from adjacent combustor cans in the plurality of consecutively arranged combustor cans.

5. A method for suppressing the dynamic interaction among combustor cans in a gas turbine combustion engine, said method comprising the steps of:

providing a plurality of consecutively arranged cans for generating respective streams of combustion gases therein and collectively discharging the streams of combustion gases;

providing a plurality of resonators, wherein at least one resonator is coupled to selected combustor cans in the plurality of consecutively arranged combustor cans, the selected combustor cans consisting of d to every third combustor can in the plurality of consecutively arranged combustor cans; and selectively tuning the plurality of resonators to suppress one or more of out-of-phase and in-phase dynamic interactions of the streams discharged from adjacent combustor cans in the plurality consecutively arranged combustor cans.

* * * * *

UNITED STATES PATENT AND TRADEMARK OFFICE

CERTIFICATE OF CORRECTION

PATENT NO. : 8,408,004 B2
APPLICATION NO. : 12/485505
DATED : April 2, 2013
INVENTOR(S) : Lewis Berkley Davis, Jr. et al.

It is certified that error appears in the above-identified patent and that said Letters Patent is hereby corrected as shown below:

In the Claim

Claim 5, column 12, line 38, "selected combustor cans consisting of d to every third" should read --selected combustor cans consisting of every third--

Signed and Sealed this
Twenty-seventh Day of May, 2014

Michelle K. Lee

Michelle K. Lee
*Deputy Director of the United States Patent and Trademark Office*